US005484555A

United States Patent [19]

Schepers

[11] Patent Number: 5,484,555

[45] Date of Patent: Jan. 16, 1996

[54] METHOD FOR CREATING A PH JUMP SYSTEM

[75] Inventor: Frederik Schepers, Breukelen, Netherlands

[73] Assignee: Lever Brothers Company, Division of Conopco, Inc., New York, N.Y.

[21] Appl. No.: 217,538

[22] Filed: Mar. 24, 1994

Related U.S. Application Data

[63] Continuation-in-part of Ser. No. 945,188, Sep. 15, 1992, abandoned.

[51] Int. Cl.[6] ..... C11D 3/26; C11D 3/28; C11D 3/30; C11D 3/33

[52] U.S. Cl. ..... 252/541; 252/98; 252/102; 252/153; 252/173; 252/174.12; 252/174.23; 252/542; 252/544; 252/546; 252/DIG. 12

[58] Field of Search ..... 252/81, 178, 98, 252/102, 174.12, DIG. 12, 523, 525, 527, 529, 541, 544, 546, 548, 153, 173, 174.23, 542, 524

[56] References Cited

U.S. PATENT DOCUMENTS

| | | | |
|---|---|---|---|
| 3,671,447 | 6/1972 | Kowalski | 252/180 |
| 3,699,047 | 10/1972 | Petrey, Jr. | 252/178 |
| 3,910,854 | 10/1975 | Meyer | 252/135 |
| 4,002,571 | 1/1977 | Anderle et al. | 252/541 |
| 4,019,859 | 4/1977 | Lavin et al. | 252/178 |
| 4,069,066 | 1/1978 | Hindle et al. | 252/546 |
| 4,119,557 | 10/1978 | Postlethwaite | 252/99 |
| 4,145,303 | 3/1979 | Loudas | 252/156 |
| 4,164,477 | 8/1979 | Whitley | 252/99 |
| 4,203,859 | 5/1980 | Kirn et al. | 252/174.23 |
| 4,305,837 | 12/1981 | Kaminsky et al. | 252/174.12 |
| 4,318,818 | 3/1982 | Letton et al. | 252/174.12 |
| 4,375,421 | 3/1983 | Rubin et al. | 252/110 |
| 4,417,993 | 11/1983 | Gergely | 252/90 |
| 4,435,303 | 3/1984 | Abadi | 252/80 |
| 4,714,597 | 12/1987 | Treviño | 252/389.52 |
| 4,820,436 | 4/1989 | Andree et al. | 252/544 |
| 4,959,179 | 9/1990 | Aronson et al. | 252/135 |
| 4,992,194 | 2/1991 | Liberati et al. | 252/99 |
| 4,992,212 | 2/1991 | Corring et al. | 252/542 |
| 5,073,285 | 12/1991 | Liberati et al. | 252/94 |
| 5,089,163 | 2/1992 | Aronson et al. | 252/135 |

FOREIGN PATENT DOCUMENTS

| | | |
|---|---|---|
| 1372979 | 11/1963 | France . |
| 53-56202 | 5/1978 | Japan . |

*Primary Examiner*—Paul Lieberman
*Assistant Examiner*—Ardith Hertzog
*Attorney, Agent, or Firm*—Ronald A. Koatz

[57] ABSTRACT

The present invention relates to a composition in which the pH is raised when diluted in the wash and which composition comprises (1) a surfactant system; (2) an N-containing compound and (3) metal salt from group 1B to 8B of the periodic table and/or a metal salt from group 3A or 4A of the periodic table. The N-compound and metal are believed to form a complex which reduces pH in product, but which raises pH when the complex dissociates in the wash. The invention further relates to a process of creating a pH jump system while laundering or cleaning hard surfaces using such a composition.

11 Claims, No Drawings

METHOD FOR CREATING A PH JUMP SYSTEM

This is a continuation-in-part of Ser. No. 07/945,188 filed Sep. 15, 1992, now abandoned.

BACKGROUND OF THE INVENTION

1. Field of the Invention

The present invention relates to compositions, e.g., heavy duty detergent compositions, automatic dishwashing liquid detergent compositions or hard surface cleaning compositions containing a detergent surfactant system and further containing both a nitrogen containing compound and one or more specific metal salts. The metal salt and nitrogen containing compound are believed to complex and disassociate in such a way as to create a pH jump system. More specifically, the pH of the composition is maintained at a desired level in product and yet rises upon product dilution. The invention further relates to a method of creating a pH jump system while laundering (i.e., increasing pH of wash solution) by diluting a composition containing said surfactant system, said N-containing compound and said metal salt.

2. Background of the Invention

Liquids which have a lower pH in product form than when they are diluted in wash are desirable for a number of reasons.

First, lower product pH is desirable for providing improved stability for compositions comprising one or more enzymes. That is, high product pH (e.g., pH above 7) is known to denature and destabilize enzymes. In addition, high product pH is known to destabilize peracid bleach compounds. While certain peracid bleaching compounds can be stably incorporated in liquid detergent products at low pH, a pH close to the pKa of the compound (e.g., pH of about 8) is required for optimal bleaching performance. Furthermore, since high pH is desirable for increased detergency in the wash,it is desirable to have a pH "jump" on dilution of a liquid product from a range which is more stabilizing to the enzyme or peracid (i.e., lower pH range) to a range providing greater detergent activity.

Both U.S. Pat. No. 4,959,179 to Aronson et al. and U.S. Pat. No. 5,089,163 to Aronson et al., teach compositions in which a pH jump system is used to stabilize lipase in the presence of a protease and in which the pH increases from product to dilution in the wash. The pH-jump system used in these references is a combination of polyols and borate.

Both U.S. Pat. No. 4,992,194 to Liberati et al. and U.S. Ser. No. 07/860,828 (filed Mar. 31, 1992), assigned to the same assignee as the subject invention, teach a polyol/borate pH jump system for stabilizing peracid compounds. However, it is desirable to find pH systems which do not use borate.

U.S. Pat. No. 4,992,212 to Corring et al. teaches light duty liquid detergent compositions comprising an organic base, such as amines, a zinc salt, and a complexing agent. The compositions of the reference have a pH of 9–11. Since the organic base is already close to or at its buffering pH (i.e., pH of the composition is already above 9), it is clear that no pH "jump" system is contemplated. That is, given this starting pH, there is really no room for a jump to occur. Moreover, the reference is concerned with light duty liquids useful in cleaning dishes and certainly does not teach or suggest a method of creating a pH jump system while laundering (e.g., washing clothes).

U.S. Pat. No. 4,069,066 to Hindle et al., cited as a reference in the parent application of the subject application, discloses a method and composition for cleaning polished surfaces. The composition comprises an amine-derived nitrogenous surfactant, amine impurities introduced into the composition with the surfactant, a salt of a metal ion capable of complexing the amines, and water. The impurities are said to be introduced during formation of the nitrogenous surfactant (column 5,lines 17–19). The amounts of metal salt exemplified are extremely small and appear to be below the amounts contemplated by the subject invention. Moreover, the reference is concerned with cleaning polished surfaces and is certainly not concerned with a method of creating a pH jump system while laundering.

U.S. Pat. No. 4,318,818 to Letton et al. relates to a stabilized aqueous enzyme composition which contain a surfactant system, N-containing compounds and calcium ions. It is said that zinc may replace the calcium. Even if this were so, however, the maximum amount of calcium (i.e., 10 millimoles) corresponds to 0.04% calcium or 0.065% zinc which is below the amount of metal cation used in the invention of the subject application. Moreover, the reference is completely unconcerned with a method of creating a pH jump system while laundering.

U.S. Pat. No. 4,002,571 to Anderie refers to cleaning compositions in which surfactant should be present in minor amounts and desirably be absent altogether.

U.S. Pat. No. 4,117,557 to Postlethwaite is clearly concerned with powder compositions which have nothing to do with pH. The only reference to pH in the reference is to already diluted compositions.

Thus, there is a need in the art for compositions which have an initial pH more stable to enzymes or peracids (i.e., pH of 8 and below). There is further a need in the art to provide a method of creating pH jump systems (for laundering) which are alternative to the borate/polyol system of the art.

SUMMARY OF THE INVENTION

Unexpectedly, applicants have now found that an undiluted composition having an initial pH of from 5.0 to 8.0 comprising (1) a detergent surfactant system; (2) a nitrogen-containing compound and (3) a metal salt which may be a metal salt selected from group 1B to 2B of the periodic table and/or a metal salt selected from group 3A or 4A of the periodic table may function as a "jump" system such that the pH of the undiluted product is lower than the pH resultant from a 0.5 g/l dilution of the product. Preferably, there will be a rise of at least 0.5 pH units upon dilution of the stored product in the wash. Such a composition has the additional advantage that it may comprise the normally pungent ammonia as the N-compound since ammonia has no odor at low pH and the odor is virtually undetectable at high dilution.

The invention further comprises a method of creating a pH jump system while washing (e.g., clothes) or cleaning of fabric or hard surfaces which method comprises diluting a composition containing the above-identified surfactant system, N-containing compound and metal salt.

DETAILED DESCRIPTION OF THE INVENTION

The subject invention relates to novel compositions which have an initial pH of about 5.0 to 8.0, and which comprise (1) a detergent surfactant system; (2) a nitrogen-containing compound and (3) metal salt which may be a metal salt selected from group 1B to 2B of the periodic table and/or a metal salt selected from group 3A or 4A of the periodic table; wherein the molar ratio of metal ion to N-containing compound is from 0.1 to 2; wherein the pH of the undiluted liquid detergent composition is lower than a 0.5 g/l dilution of the product; and wherein the pH of the composition increases at least 0.5 pH units upon dilution. It should be noted that, for purposes of conducting experiments, in those solutions which are salt solution only (i.e., have no surfactant), dilution was 0.75 g/l. In other examples dilution was 1.5 g/l. This is because the salt solution typically makes up 50% of the liquid formulation and the surfactants, which typically make up the other 50%, do not influence pH jump. Thus in those examples, a 0.75 g/l solution is equivalent to 1.5 g/l of a whole product in the other examples.

Preferably, the pH of the composition which has been diluted in the wash will be at least 0.5 pH units higher than the undiluted product.

Although it is not believed to make any difference, all dilution experiments are conducted using deionized water.

While not wishing to be bound by theory, it is believed that the alkaline, nitrogen-containing compound complexes with the metal ion and leads to an excess of free protonated (conjugated) acidic N-compound in solution and consequently to a lower pH in the undiluted product. When the complex is diluted in the wash, it is believed that the complex will at least partially dissociate and thereby increase the pH in the wash.

In can be seen that, at least to some extent, the pH of the product before and after dilution will depend on the extent to which the N-compound complexes with the metal in the product and to the extent the N-compound/metal complex dissociates in the diluted wash. For example, although a strong complex may lead to a low pH (because of the large amounts of the free conjugated acid which is free in the solution), if the complex does not readily dissociate upon dilution, then the pH of the system will not rise upon dilution.

The N-containing compounds of the invention may include monoethanolamine, pyrrolidine, n-butyl amine, s-butyl amine, 4-amino-1-butanol, 6-amino-1-hexanol, t-butylamine, cyclohexylamine, piperidine, trimethylenediamine, 1,6-diaminohexane, ethylene diamine, 2,6-dimethylpliperidine, 2-amino-1-butanol, benzylamine, N-benzylmethylamine, glucosmine, and 3-amino-1-propanol. Other N-containing compounds include triethanolamine, amino acids such as lysine, alanine, etc and, of course, ammonia (NH3).

Preferred compounds include ammonia and the primary and secondary amines such as monoethanolamine (MEA) and amino acids. Again, while not wishing to be bound by theory, it is believed that N-compounds having more available hydrogens (e.g., ammonia and primary amines) will form a stronger complex and will provide a greater pH jump when the complex dissociates. Of course, as mentioned above, the extent of the pH jump depends in part on how easily the complex can dissociate in the wash and this will be a function of the various dissociation constants of the metals.

In addition to compounds mentioned above, the N-compound may also be a functional compound (e.g., builder or water softener) containing one or more carboxylic acid group such as nitrilotriacetate (NTA), a salt of dipiccolinic acid (DPA) or ethylene diamine tetraacetate (EDTA). The N-containing, carboxylic acid group containing compound may be a compound with a ring structure (i.e., DPA) or without a ring structure (i.e., NTA).

The use of a functional water softening compound may be desirable in that it allows the compound to function both as a softener and a buffer. This may be particularly advantageous in composition where large amounts of builder/water softener are tolerated.

Choice of an N-containing compound may also depend in part on what the desired pH range to be buffered may be (for example, ammonia tends to buffer at lower pH than monoethanolamine). Which compound is ultimately used does not really matter except that the N-compound/metal used must be able to dissociate in the wash to the extent that pH on dilution (1.5 g dilution of the product) is higher than pH prior to dilution. Preferably, the pH of the original composition is 5.0 to 8.0, and there will be a rise in pH upon dilution in the wash of at least 0.5 pH units.

The amount of N-containing compound may vary widely depending on the type of salt, the desired pH buffer range, and whether the salt has a function other than buffering. Thus, for example, the amount of NTA used in an autodish composition may reach 50% by weight of the composition. In general, the N-containing compound will comprise from 0.05 to 50%, preferably 0.05 to 30%, most preferably from 0.05 to 15% of the final detergent composition.

The metal salt used to form the complex may be a transition metal salt selected from group 1B to 8B of the periodic table and/or a metal salt from group 3A or 4A of the periodic table. Preferred salts include zinc, aluminum, manganese, iron and copper and especially preferred metals include $Zn^{2+}$, $Al^{3+}$ and $Mn^{3+}$. While any of these salts may be used, as indicated above, to the extent that some salts will complex more or less strongly with the N-compound, the extent of the "jump" may be controlled to some extent that some salts will complex more or less strongly with the N-compound, the extent of the "jump" may be controlled to some extent by choice of type and amount of complexing salt. One especially preferred salt is water soluble zinc salt.

Of course, it will be understood that solubility to some extent depends on the amount of salt used. Suitable inorganic metal salts which may be used include soluble metal halides, metal sulfate and metal nitrate; and suitable organic metal salts include metal formate and metal acetate.

Also, it should be noted that,if a finished complex (i.e., N-compound, metal and anion/cation) is available from any other source, this finished complex may be placed directly into the composition rather than having the metal complex form in situ.

The salts may be present in an amount ranging from 0.05 to 25%, preferably 0.1 to 15%, most preferably 0.5 to 10% of the compositions. The metal ion itself should comprise 0.07 to 25% by weight, preferably 0.1 to 15% by weight. This amount of ion should be solubilized in the solution.

The metal ion and N-containing compound should ideally be used in an amount such that the ratio of metal ion to N-containing compound is from about 0.1 to about 2, preferably 0.2 to about 1.5.

The lipolytic enzyme used may be either a fungal lipase producible by Humicola lanuginosa and Thermomyces lanuginosus, or a bacterial lipase which show a positive immunological cross-reaction with the antibody of the lipase produced by the microorganism Chromobacter viscosum var. lipolyticum NRRL B-3673. This microorganism has been described in Dutch patent specification No. 154,269 of Toyo Jozo Kabushiki Kanisha and has been deposited with the Fermentation Research Institute, Agency of Industrial Science and Technology, Ministry of International Trade & Industry,Tokyo, Japan, and added to the permanent collection under N. K Hats Ken Kin K 137 and is available to the public at the United States Department of Agriculture, Agricultural Research Service, Northern Utilization and Development Division at Peoria, Ill., U.S.A., under the n. NRRL B-3673. The lipase produced by this microorganism is commercially available from Toyo Jozo Co., Tagata, Japan, hereafter referred to as "TJ lipase". These bacterial lipases of the present invention should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0 - antigen in complete Freund's adjuvant day 4 - antigen in complete Freund's adjuvant day 32 - antigen in incomplete Freund's adjuvant day 60 - booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipase showing a positive immunological cross-reaction with the TJ-lipase antibody as hereabove described are lipases suitable in the present invention. Typical examples thereof are the lipase ex Pseudomonas fluorescens IAM 1057 available from Amano Pharmaceutical Co., Nagoya, Japan under the trade-name Amano-P lipase, the lipase ex Pseudomonas fragi FERM P 1339 (available under the trade-name Amano-B), the lipase ex Pseudomonas nitroreducens var. lipolyticum FERM P 1338, the lipase ex Pseudomonas sp. available under the trade name Amano CES, the lipase ex Pseudomonas cepacia, lipases ex Chromobacter viscosum, e.g., Chromobacter viscosum var. lipolyticum NRRL B-3673, commercially available from Toyo Jozo Co., Tagata, Japan; and further Chromobacter viscosum lipases from U.s. biochemical Corp. U.S.A. and Diosynthe Co., The Netherlands, and lipases ex Pseudomonas gladioli.

An example of a fungal lipase as defined above is the lipase ex Humicola lanuginosa, available from Amano under the trade name Amano CE; the lipase ex Humicola lanuginosa as described in the aforesaid European Patent Application No. 0,258,068 (NOVO), as well as the lipase obtained by cloning the gene from Humicola lanuginosa and expressing this gene in Aspergillus oryzae, commercially available from NOVO Industri A/S under the trade name "Lipolase". This Lipolase is a preferred lipase for use in the present invention.

The lipases of the present invention are included in the liquid detergent composition in such an amount that the final composition has a lipolytic enzyme activity of from 100 to 0.005 LU/ml, preferably 25 to 0.05 LU/ml of the composition.

A Lipase Unit (LU) is that amount of lipase which produces 1 pmol of titratable fatty acid per minute in a pH stat. under the following conditions: temperature 30° C.; pH=9.0; substrate is an emulsion of 3.3 wt. % of olive oil and 3.3% gum arabic, in the presence of 13 mmol/L $Ca^{2+}$ and 20 mmol/L NaCl in 5 mmol/L Trisbuffer.

Naturally, mixtures of the above lipases can be used. The lipases can be used in their non-purified form or in a purified form, e.g., purified with the aid of well known adsorption methods, such as phenyl sepharose adsorption techniques.

A proteolytic enzyme may also, and is preferably, used in the present invention and can be of vegetable, animal or microorganism origin. Preferably it is of the latter origin, which includes yeasts, fungi, molds and bacteria. Particularly preferred are bacterial subtilisin type proteases, obtained from e.g., particular strains of B. subtills and B. licheniformis. Examples of suitable commercially available proteases are Alcalase, Savanase, Esperase, all of NOVO Industri A/S; Maxatase and Maxacal of Gist-Brocades; Kazusase of Showa Denko; BPN and BPN proteases and so on. The amount of proteolytic enzyme, included in the composition, ranges from 0.1–50 GU/mg, based on the final composition. Naturally, mixtures of different proteolytic enzymes may be used.

A GU is a glycine unit, which is the amount of proteolytic enzyme which under standard incubation conditions produces an amount of terminal $NH_2$ groups equivalent to 1 microgramme/ml of glycine.

Stabilizers or stabilizer systems may be used in conjunction with enzymes and generally comprise from about 0.1 to 15% by weight of the composition.

The enzyme stabilization system may comprise calcium ion, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.5% to about 15%, preferably from about 1.0% to about 8% by weight of the composition.

The compositions of the invention should comprise one or more detergent active materials such as soaps, synthetic anionic, nonionic, amphoteric or zwitterionic detergent materials or mixtures thereof. These materials are all well known in the art. Preferably the compositions contain an anionic detergent or a mixture of a nonionic and an anionic detergent. Nonionic detergents are well known in the art. They are normally reaction products of compounds having a hydrophobic group and a reactive hydrogen atom, for example, aliphatic alcohols, acids, amides or alkylphenols with alkylene oxides, especially ethylene oxide either along or with propylene oxide. Typical examples of suitable nonionic detergents are alkyl ($C_6$–$C_{22}$) phenolethylene oxide condensation products, with generally 5–25 moles of ethylene oxide per mole of alkylphenol, the condensation products of aliphatic $C_8$–$C_{18}$ primary or secondary, linear or branched chain alcohols with generally 5–40 moles of ethylene oxide, and products made by condensation of ethylene oxide and propylene oxide with ethylenediamine. Other nonionic detergents include the block copolymers of ethylene oxide and propylene oxide, alkylpolyglycosides, tertiary amineoxides and dialkylsulphoxides. The condensation products of the alcohols with ethylene oxide are the preferred nonionic detergents.

Anionic detergents, suitable for inclusion in the compositions of the present invention include the $C_{10}$–$C_{24}$ alkylbenzenesulphonates, the $C_{10}$–$C_{18}$ alkanesulphonates, the $C_{10}$–$C_{24}$ alkylethersulphates with 1–10 moles of ethylene and/or propylenoxide in the ether variety and so on.

In general, the compositions may contain the detergent active compounds in an amount of 5–90, usually 1–70 and preferably 15–50% by weight.

The liquid detergent compositions of the present invention can furthermore contain one or more other, optional ingredients. Such optional ingredients are e.g. perfumes, including deoperfumes, coloring materials, opacifiers, soil suspending agents, soil release agents, solvents such as ethanol, ethylene glycol, propylene glycol, hydrotropes such as sodium cumene-, toluene- and xylene sulphonate as well as urea, alkaline materials such as mono-, di- or triethanolamine, clays, fabric softening agents and so on.

The liquid detergent composition may be unbuilt or built. If a built liquid detergent composition is required, the composition may contain from 1–60%, preferably 5–30% by weight of one or more organic and/or inorganic builder. Typical examples of such builders are the alkalimetal ortho-, pyro- and tri-polyphosphates, alkalimetal citrates, carboxyethyloxy succinates, zeolites, polyacetal carboxylates and so on.

The compositions may furthermore comprise lather boosters, foam depressors,anti-corrosion agents, chelating agents, anti soil redeposition agents, bleaching agents, other stabilizing agents for the enzymes such as glycerol, sodium formate, calcium salts and the like, activators for the bleaching agents and so on. They may also comprise enzymes other than the proteases and lipases, such as amylases, oxidases and cellulases. In general, the compositions may comprise such other enzyme in an amount of 0.01–10% by weight.

The liquid detergent compositions of the invention may further comprise an amount of electrolyte (defined as any water soluble salt) whose quantity depends on whether or not the compositions is structured. By structured is meant the formation of a lamellar phase sufficient to endow solid supporting capability.

More particularly, while no electrolyte is required for a non-structured, non-suspending composition, at least 1%, more preferably at least 5% by weight and most preferably at least 15% by weight electrolyte is used. The formation of a lamellar phase can be detected by means well known to those skilled in the art.

The water soluble electrolyte salt may be a detergency builder, such as the inorganic salt sodium tripolyphosphate or it may be a non-functional electrolyte such as sodium sulfate or chloride. Preferably, whatever builder is used in the composition comprises all or part of the electrolyte.

The liquid detergent compositions of the invention may also contain deflocculating polymers such as described in U.S. Pat. No. 4,992,194 to Liberati et al., hereby incorporated into the subject application by reference.

Finally the liquid detergent composition of the invention may require a peracid.

The peracid or peroxy acid compounds which may be used include 1 ,(2-diperoxydodecanedioic acid (DPDA) and any of the other monoperoxy and a diperoxy acids described in U.S. Pat. No. 4,642,198 to Humphreys et al. and which is hereby incorporated into the subject application by reference; and further include N-phthaloyl aminoperoxycaproic acid (known in the industry as "PAP") and the other peracids described in U.S. Pat. No. 4,992,194 to Liberati et al., which is also hereby incorporated by reference into the subject application.

Other peracids which may be used include the amido and imido peroxyacid bleaches described in U.S. Ser. No. 07/860,828 to Coope et al., filed Mar. 31, 1992, which is hereby incorporated by reference into the subject application.

In a second embodiment of the invention, the method relates to a method of creating a pH jump system while laundering which method comprises diluting in the wash a composition containing a detergent surfactant system, an N-containing compound and metal salt wherein each of these three components is defined as above.

Unless stated otherwise, all percentages used in the specification and examples are percentages by weight.

The invention will further be illustrated by way of the following example which are not intended to be limiting in any way.

EXAMPLES

Compositions comprising water,sodium citrate, citric acid, N-compound, and metals as defined according to the invention above were prepared asset forth in Table A below and properties of the compositions (regarding jump in pH from concentrate product to diluted product) are set forth in Table B.

TABLE A

Examples 1–12 - Compositions with N-compounds and metal ions (amounts in grams)

| | | Sodium- | Citric- | N-compound | | Metal salt | | Ratio of metal cation to N- |
|---|---|---|---|---|---|---|---|---|
| No. | Water | citrate | acid | Type | Amount | Type | Amount | Cpds |
| A | 100 | 15.5 | 5.5 | NH3 | 1.9 | — | — | |
| 1 | 100 | 15.5 | 5.5 | NH3 | 1.9 | ZnAc | 12.4 | .51 |
| 2 | 95 | 15.4 | 10.3 | MEA | 12.2 | ZnAc | 18.4 | .42 |

TABLE A-continued

| Examples 1–12 - Compositions with N-compounds and metal ions (amounts in grams) | | | | | | | | |
|---|---|---|---|---|---|---|---|---|
| | | Sodium- | Citric- | N-compound | | Metal salt | | Ratio of metal cation to N- |
| No. | Water | citrate | acid | Type | Amount | Type | Amount | Cpds |
| 3 | 95 | 16.7 | 0 | Alan-ine | 8.9 | ZnAc | 5.9 | .27 |
| 4 | 95 | 16.5 | 0 | TEA | 17.9 | ZnAc | 12.3 | .47 |
| 5 | 95 | 0 | 1.58 | NTA | 20 | ZnAc | 6.94 | .40 |
| 6 | 119 | 0 | 7.6 NaOH | DPA | 15.8 | ZnAc | 16.24 | 1.01 |
| 7 | 95 | 15.4 | 6.6 | MEA | 12.2 | AlSu | 21.2 | .62 |
| 8 | 100 | 16.5 | 7.0 | NH3 | 1.9 | AlSu | 6.55 | |
| 9 | 100 | 16.5 | 7.4 | NH3 | 1.9 | $Fe_2S$ | 8.78 | |
| 10 | 100 | 16.5 | 7.35 | NH3 | 1.9 | $Fe_3S$ | 0.99 | |
| 11 | 100 | 16.5 | 5.81 | NH3 | 1.9 | $CuCl_2$ | 1.99 | |
| 12 | 100 | 16.5 | 6.5 | NH3 | 1.9 | $Mn(Ac)_3$ | 7.8 | .24 |
| B | 100 | 1.63 | 7.8 | NH3 | 1.9 | $MgCl_2$ | 29.7 | |
| C | 98.9 | — | 3.9 $H_2SO_4$ | NH3 | 1.9 | $CaCl_2$ | 22.8 | |

Ac = Acetate
Su = Sulfate

TABLE B

| Properties of these solutions | | |
|---|---|---|
| No. | pH Concentrate | pH 0.75 g/l |
| A | 8.80 | 7.5 |
| 1 | 6.36 | 8.59 |
| 2 | 6.41 | 8.5 |
| 3 | 6.54 | 8.12 |
| 4 | 7.20 | 7.96 |
| 5 | 5.85 | 8.74 |
| 6 | 6.74 | 7.3 |
| 7 | 6.65 | 7.45 |
| 8 | 6.02 | 6.32 |
| 9 | 6.65 | 6.83 |
| 10 | 6.52 | 7.01 |
| 11 | 6.56 | 7.33 |
| 12 | 6.59 | 7.98 |
| B | 7.78 | — |
| C | 8.36 | — |

ZnAc = $Zn(Ac)_2.2aq$
AlSu = $Al_2$ $(SO4)_3$
$Fe_2Su$ = FeSO4.7aq
$Fe_3Su$ = $Fe_2$ $(SO4)_3.4aq$
$CuCl_2$ = $CuCl_2.2aq$
MnAc3 = $Mn(Ac)_3.4aq$
$MgCl_2$ = $MgCl_2.2aq$
$CaCl_2$ = $CaCl_2.2aq$
Ac = Acetate
NTA = Nitrilotriacetate laq
DPA = dipiccolinic acid Although theoretically the pH of a dispersion will vary from that of a solution, operationally these pH differences are taken into account. It is well understood by those skilled in the art that the pH values are operational pH values. In the experiments above, pH was measured using a Corning, General Purpose Combination pH electrode with AgCl internal reference sealed by ion exchange barrier (Catalog number 476531 ).

It should also be noted that, since the examples above were salt solutions only rather than full detergent formulations, dilution was 0.75 g/l only. The rationale for this was that salt solution typically makes up 50% of the liquid formulations, while the other 50% are typically surfactants which do not influence pH-jump. Thus, 0.75 g/l of the salt solution is equivalent to 1.5 g/l of the whole product.

As seen from Comparative A, when no ion is used, the pH of the undiluted product (concentrate) in the presence of the N-compound is higher than the pH of the diluted product.

Example 1–7 demonstrate that various N-based compounds, including amines and amino acid, can be used with zinc or aluminum metal salts.

The examples show that transition metals such as Zn, Mn and Cu decrease pH of undiluted product, while giving a high pH of the diluted product. Aluminum and iron lead to wash pHs only slightly higher than bottle pH. While not wishing to be bound by theory, this is believed to result from the fact that the Al and Fe ions form strong, complex which dissociate on dilution only with great difficulty. Another possibility is that, since the hydrates of aluminum and iron are acid, these help keep pH low even upon dilution. In comparative examples B and C, it can be seen that Ca and Mg ions do not significantly reduce pH in the undiluted product.

EXAMPLE 13

Heavy Duty Liquid (HDL) Formulation and Bleach Stability

An N-containing compound (i.e., NH3) and zinc salts were formulated in composition as set forth below:

TABLE C

| Full HDL formulation with $Zn^{2+}/NH_3$ | |
|---|---|
| Water | 42.3 |
| Sodium Citrate | 6.8 |
| Citric Acid | 2.4 |
| NaOH | 3.2 |
| $NH_3$ | 0.9 |
| Decoupling polymer | 1.0 |
| Zn(Ac) 2.2aq | 5.2 |
| BDA | 26.2 |
| Neodol 25-9 | 12.0 |
| pH product | 6.5 |
| pH 1.5 g/l | 8.3 |

TABLE C-continued

| Full HDL formulation with $Zn^{2+}/NH_3$ | |
|---|---|
| Viscosity 21 s-1 | 200 mpas |

BDA = Dodecylbenzene sulphonic acid
pH measured as in Examples 1–12
Dilution (full product) was 1.5 g/l
Ratio of metal to N-compound was .45
Decoupling polymer = acrylate/lauryl methacrylate copolymer with AA/LMA molar ratio of about 25:1 and having mass averaged molecular weight of about 3900

The stability of N,N'-di(4-percarboxybenzoyl)piperazine (PCBPIP) in the HDL with and without $Zn^{2+}$ at 37° C. was then tested and results set forth below:

TABLE D

| Storage Time (time) | ppm A0 with $Zn^{2+}$ (pH = 6.5) | Storage Time (days) | ppm AO without $Zn^{2+}$ (pH = 9.4) |
|---|---|---|---|
| 0 | 1290 | 0 | 1957 |
| 1 | 1362 | 1 | 1699 |
| 7 | 1498 | 7 | 1467 |
| 34 | 1450 | 31 | 897 |
| 48 | 957 | 44 | 694 |
| 61 | 763 | 57 | 460 |

AO = Active Oxygen

As can be seen, stability of bleach (as measured by percent active oxygen remaining over period of storage) was enhanced when zinc ions were used and complex could be formed.

EXAMPLE 14

In order to see whether use of $Zn^{2+}$ would enhance stability of lipase in the presence of protease (which would otherwise hydrolyze the lipase) in the undiluted composition, Lipolase (ex Novo) and the protease enzyme Durazyn 16.OLDX (ex Novo) were used in the HDL composition of Example 13 both with and without $Zn^{2+}$. The results are set forth below:

TABLE E

| | Halflives at 37° C. in Days | |
|---|---|---|
| | HDL with $Zn^{2+}$ pH = 6.5 | HDL w/o $Zn^{2+}$ pH = 10.4 |
| Lipolase with Durazym | 26 | 1 |
| Lipolase w/o Durazym | 58 | 4 |

As can be seen from the table above, although stability of lipolase increases slightly in the absence of protease even when no $Zn^{2+}$ is used (half life from 1 day to 4 days), when $Zn^{2+}$ is used, there is a tremendous increase in half-life of the lipase both in the absence (26 days versus 1 day) and presence (58 days versus 4 days) of protease.

It should be understood that the examples and embodiments described herein are for illustrative purposes only and that various modifications or changes in the light thereof will be suggested to persons skilled in the art and are to be included within the spirit and purview of this application and the scope of the appended claims.

We claim:

1. A method for creating a pH jump system while cleaning fabric or hard surfaces comprising using a composition which comprises:

(1) 5% to 90% by wt. of a detergent surfactant selected from the group consisting of soap,anionic,nonionic, amphoteric and zwitterionic surfactants and mixtures thereof.

(2) from about 0.05 to about 50% by weight of an N-containing compound selected from the group consisting of ammonia,primary amines, secondary amines, tertiary amines and compounds which contain both a nitrogen atom and at least one carboxylic acid group;

(3) from about 0.07 to about 25% by weight of a metal salt comprising metal cation and an anion wherein the metal cation is selected from the group consisting of $Zn^{2+}$, $Al^{3+}$, $Mn^{2+}$, $Mn^{3+}$, $Mn^{4+}$, $Fe^{2+}$ and $Fe^{3+}$ and wherein the anion is any anion suitable to deliver the cation to the solution; said metal cation comprising from 0.070% to 25% by weight of the composition;

wherein the molar ratio of metal cation to N-containing compound is from 0.1 to 2.0;

wherein the pH of the undiluted solution is 5.0 to 8.0;

wherein said method comprises diluting the composition in an aqueous washing liquor such that the pH of the composition increases at least 0.5 pH units when diluted in said water, said dilution being such that there is at least 0.5 g/l aqueous solution.

2. A method according to claim 1, wherein the N-containing compound is nitrilotriacetate (NTA).

3. A method according to claim 1, wherein the N-containing compound is a salt of dipicollinic acid (DPA).

4. A method according to claim 1, wherein the primary amine is monoethanolamine.

5. A method according to claim 1, wherein the tertiary amine is triethanolamine.

6. A method according to claim 1, wherein the compound containing both a nitrogen atom and one carboxylic acid group is an amino acid.

7. A method according to claim 1, wherein the composition additionally comprises a decoupling polymer.

8. A method according to claim 1, wherein the composition additionally comprises a peracid.

9. A method according to claim 1, wherein the composition additionally comprises a protease.

10. A method according to claim 1, wherein the composition comprises an enzyme selected from the group consisting of lipases, cellulases and amylases.

11. A method according to claim 1, wherein the N-containing compound is ammonia and the metal cation is zinc.

* * * * *